US008336565B2

(12) United States Patent
Wrangberth et al.

(10) Patent No.: US 8,336,565 B2
(45) Date of Patent: Dec. 25, 2012

(54) DRAWER DISHWASHER

(75) Inventors: Stellan Wrangberth, Huskvarna (SE); Arne Hagelin, Jönköping (SE); Mats Svensson, Huskvarna (SE)

(73) Assignee: Electrolux Home Products Corporation N.V., Zaventem (BE)

( * ) Notice: Subject to any disclaimer, the term of this patent is extended or adjusted under 35 U.S.C. 154(b) by 487 days.

(21) Appl. No.: 12/519,710

(22) PCT Filed: Nov. 13, 2007

(86) PCT No.: PCT/EP2007/009801

§ 371 (c)(1),
(2), (4) Date: Dec. 7, 2009

(87) PCT Pub. No.: WO2008/067894

PCT Pub. Date: Jun. 12, 2008

(65) Prior Publication Data

US 2010/0083992 A1 Apr. 8, 2010

(30) Foreign Application Priority Data

Dec. 6, 2006 (EP) ..... 06025208

(51) Int. Cl.
*B08B 3/02* (2006.01)

(52) U.S. Cl. ..... 134/183; 134/200

(58) Field of Classification Search ..... 134/200, 134/137, 183

See application file for complete search history.

(56) References Cited

U.S. PATENT DOCUMENTS

| | | | | | |
|---|---|---|---|---|---|
| 2,654,386 | A * | 10/1953 | Wotring | 137/216.1 |
| 2,661,750 | A * | 12/1953 | McNairy | 134/115 R |
| 2,668,091 | A * | 2/1954 | Clark | 312/270.3 |
| 2,846,286 | A * | 8/1958 | Gomersall | 312/270.3 |
| 3,272,580 | A * | 9/1966 | Dean et al. | 312/409 |
| 5,755,244 | A | 5/1998 | Sargeant et al. | |
| 6,447,081 | B1 | 9/2002 | Sargeant et al. | |
| 6,460,555 | B1 | 10/2002 | Tuller et al. | |
| 7,345,264 | B2 * | 3/2008 | Yoshidome | 219/756 |
| 7,624,745 | B2 * | 12/2009 | Welch | 134/200 |
| 7,731,804 | B2 * | 6/2010 | Gunnerson et al. | 134/56 D |
| 2006/0213909 | A1 * | 9/2006 | Epp et al. | 220/254.9 |

FOREIGN PATENT DOCUMENTS

| | | | |
|---|---|---|---|
| EP | 1700558 | A | 9/2006 |
| JP | 2002-051959 | * | 2/2002 |
| JP | 2002-360495 | * | 12/2002 |
| JP | 2004-261259 | * | 9/2004 |
| WO | 9312706 | A | 7/1993 |
| WO | 2006057567 | A | 6/2006 |

OTHER PUBLICATIONS

International Search Report for PCT/EP2007/009801, dated Apr. 17, 2008, 3 pages.

* cited by examiner

*Primary Examiner* — Frankie L Stinson
(74) *Attorney, Agent, or Firm* — Pearne & Gordon LLP

(57) ABSTRACT

The present invention relates to a drawer dishwasher (1), comprising an extractable washing tub (2) for receiving objects that are to be washed, and a lid (9), for sealing engagement with the washing tub (2). The lid (9) is movable between an engagement position (A), wherein it is in sealing engagement (10) with an upper edge (6) of the washing tub (2), and an opening position (B), wherein it is spaced from the upper edge (6) of the washing tub (2). The drawer dishwasher (1) has a sealing device (10) arranged to press the lid (9), when it is in the engagement position (A), towards the upper edge (6) of the washing tub (2).

10 Claims, 11 Drawing Sheets

DRAWER DISHWASHER

TECHNICAL FIELD

The present disclosure relates to a drawer dishwasher. Particularly, the disclosure relates to a drawer dishwasher, comprising an extractable washing tub for receiving objects that are to be washed, and a lid, for sealing engagement with the washing tub, the lid is movable between an engagement position, wherein it is in sealing engagement with an upper edge of the washing tub, and an opening position, wherein it is spaced from the upper edge of the washing tub.

BACKGROUND

Drawer dishwashers are known from e.g. U.S. Pat. No. 6,460,555B1 and U.S. Pat. No. 6,447,081B1.

In drawer dishwashers it is of great importance that the lid and the extractable washing tub are properly sealed to avoid leakage.

A motor-driven system for sealing the lid towards the washing tub is known from the art. Such a system includes a lot of components and is therefore rather expensive.

U.S. Pat. No. 6,460,555 shows a prior art drawer dishwasher in which a mechanical system for sealing the lid is described. The upper drawer has a lid which moves upwardly and downwardly by means of a spring in response to the opening and closing of the drawer. The lower edges of the front wall, the side walls and the rear wall of the lid are all provided with U-shaped slots which are provided with sealing gaskets. In the arrangement according to U.S. Pat. No. 6,460,555 the sealing gaskets are of great importance, if they are damaged the risk of leakage is immediate.

Hence, an object of the invention is to provide a more simple, robust and reliable sealing arrangement to be used in drawer dishwashers.

SUMMARY

In order to solve the above problems a dishwasher according to the preamble of claim 1 is provided and which is characterized in that the sealing device is arranged on a guide rail, said guide rail being stationary arranged relative to a frame, which encloses the washing tub and the lid.

Since the sealing device presses the lid against the washing tub, the lid is reliably sealed. By arranging the dishwasher with a sealing arrangement according to the invention there is always a pressure from the lid towards the upper part of the drawer, when the lid is in the engagement position. This results in that it is possible to have a plastic to plastic contact between the lid and the upper edge of the washing tub and by that achieve a reliable sealing. By achieving the platic-to-plastic contact it is guaranteed that a sealing gasket, which is arranged on the underside of the lid is compressed just as much each time the lid is moved to the engagement position, and by this is a secure sealing between the lid and the upper edge of the washing tub guaranteed. The arrangement according to the invention is rather cheap as well, since it is realized with relatively cheap and uncomplicated components.

By providing a sealing device as stated in claim 2-5, arranged in a guide rail, comprising: A guide in which the lid is movable between the engagement position and the opening position; a projection protruding from an edge of the lid movable in the guide; and a biasing device arranged for pressing the lid towards the upper edge of the washing tub. A pressure is achieved that presses the lid towards the washing tub in the engagement position. By arranging the sealing device, according to claim 2, in a guide rail in the upper part of the dishwasher frame the distance between the sealing device and the lid is short which results in a tight and secure sealing between the lid and the upper edge of the washing tub even though the washing tub is loaded full with objects to be washed and therefore is very heavy.

By arranging at least two sealing devices as stated in claims 6 and 7 a well-balanced pressure is provided which increases the security of the seal.

By providing a sealing device according to claim 8 wherein each of the two guides comprises at least two guides and at least two biasing devices a well-balanced pressure on four points is provided which results in a very tight and reliable sealing between the lid and the upper edge of the washing tub and even if some component would get stuck or brake in one of the four points, the function of the sealing device is maintained.

In one embodiment of the invention the biasing device is a spring. The tension in the spring urges the lid towards the washing tub and presses the lid towards the washing tub.

By providing a lid, a front part of the lid will protrude from the front side of the dishwasher when in the opening position. Hence, the protruding front part of the lid can serve to protect the counter and/or the wooden doors of the kitchen against stream from the dishwasher drawer.

The front part preferably protrudes by about 30-40 mm, most preferably 32 mm, when the lid is in the opening position.

DESCRIPTION OF EMBODIMENTS

Figure 1:
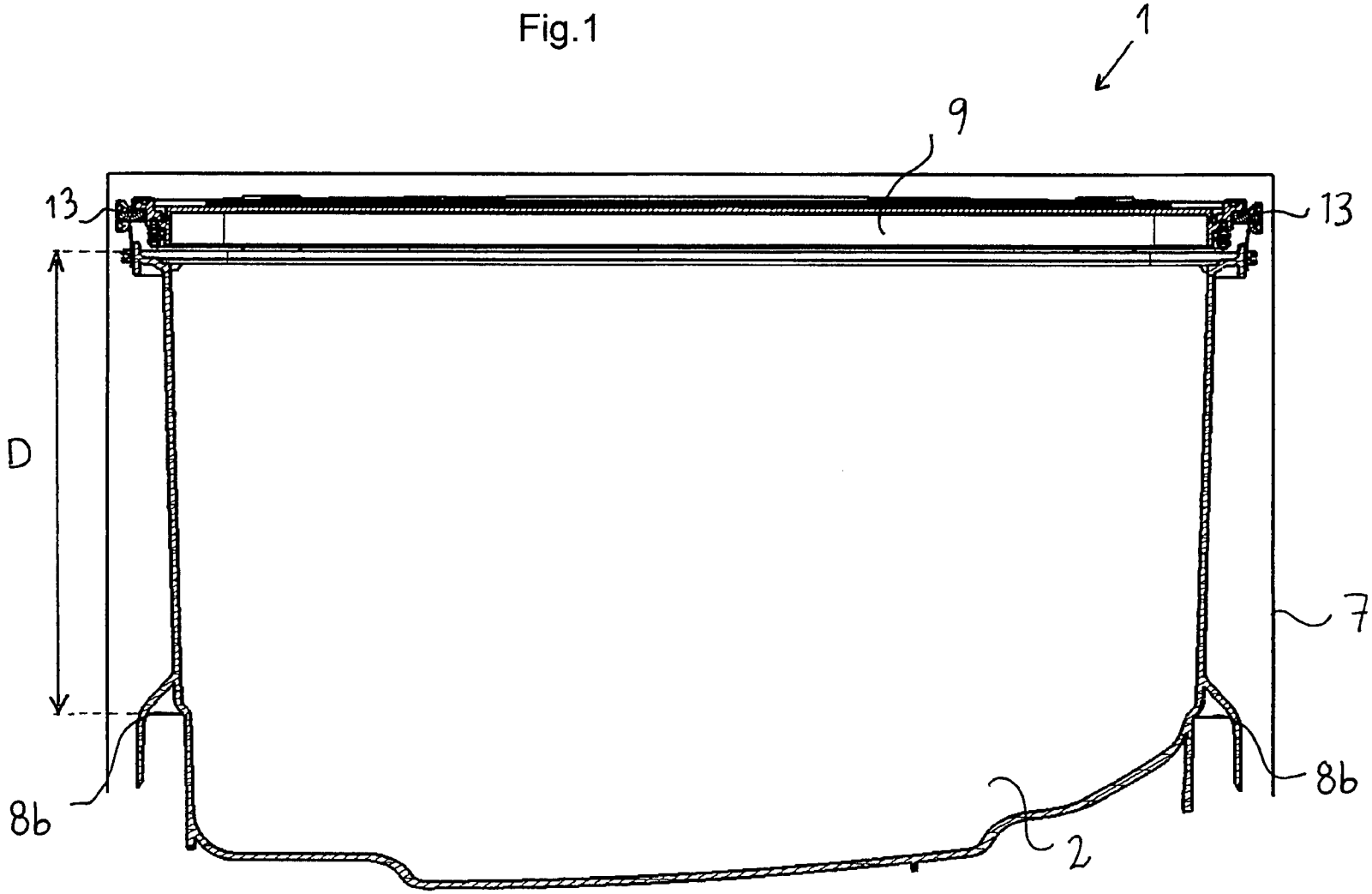
FIG. 1 schematically illustrates a front view of a drawer dishwasher according to the invention.
Figure 2:
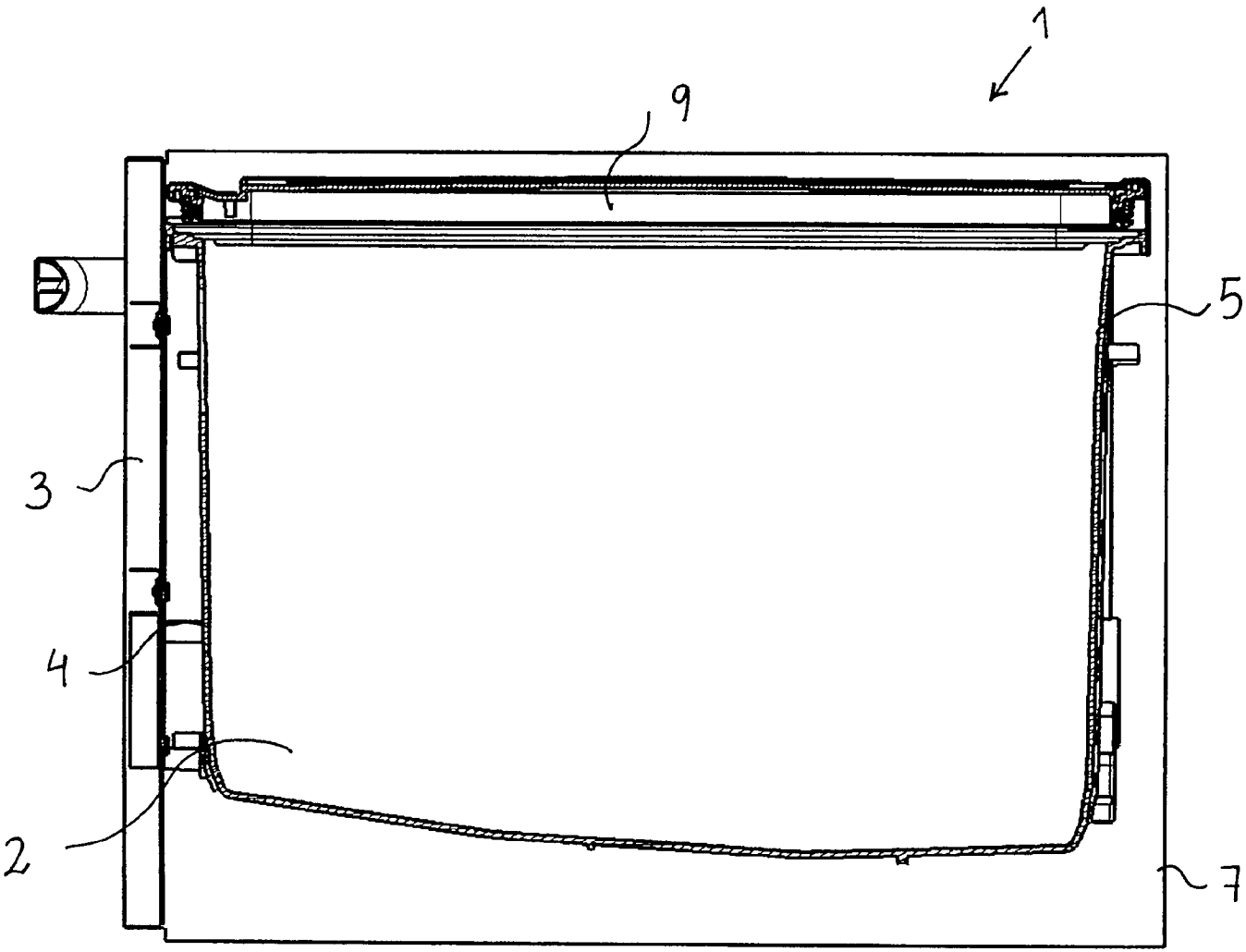
FIG. 2 schematically illustrates a cross section of a side view of a drawer and a lid when in an engagement position (closed position).
Figure 3:
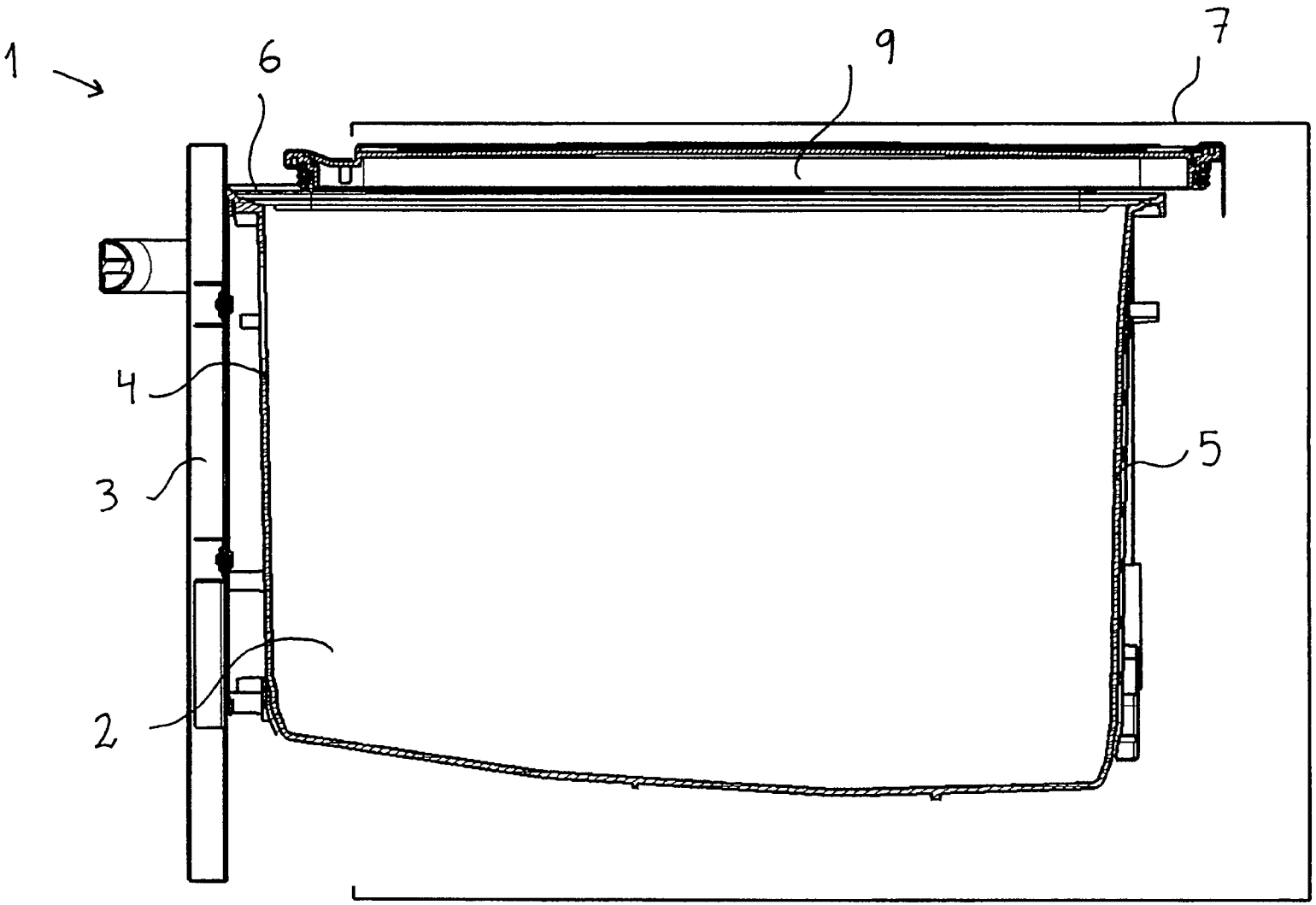
FIG. 3 schematically illustrates a cross section of a side view of a drawer and a lid when in an opening position.

FIGS. 1-3 illustrates a drawer dishwasher 1, comprising: an extractable washing tub 2 for receiving objects that are to be washed. The washing tub 2 comprises a front wall 4, a rear wall 5, two side walls and a bottom part. The washing tub 2 has a an upper edge 6. The washing tub 2 is preferably made of rigid plastic, or that like.

Figure 4:
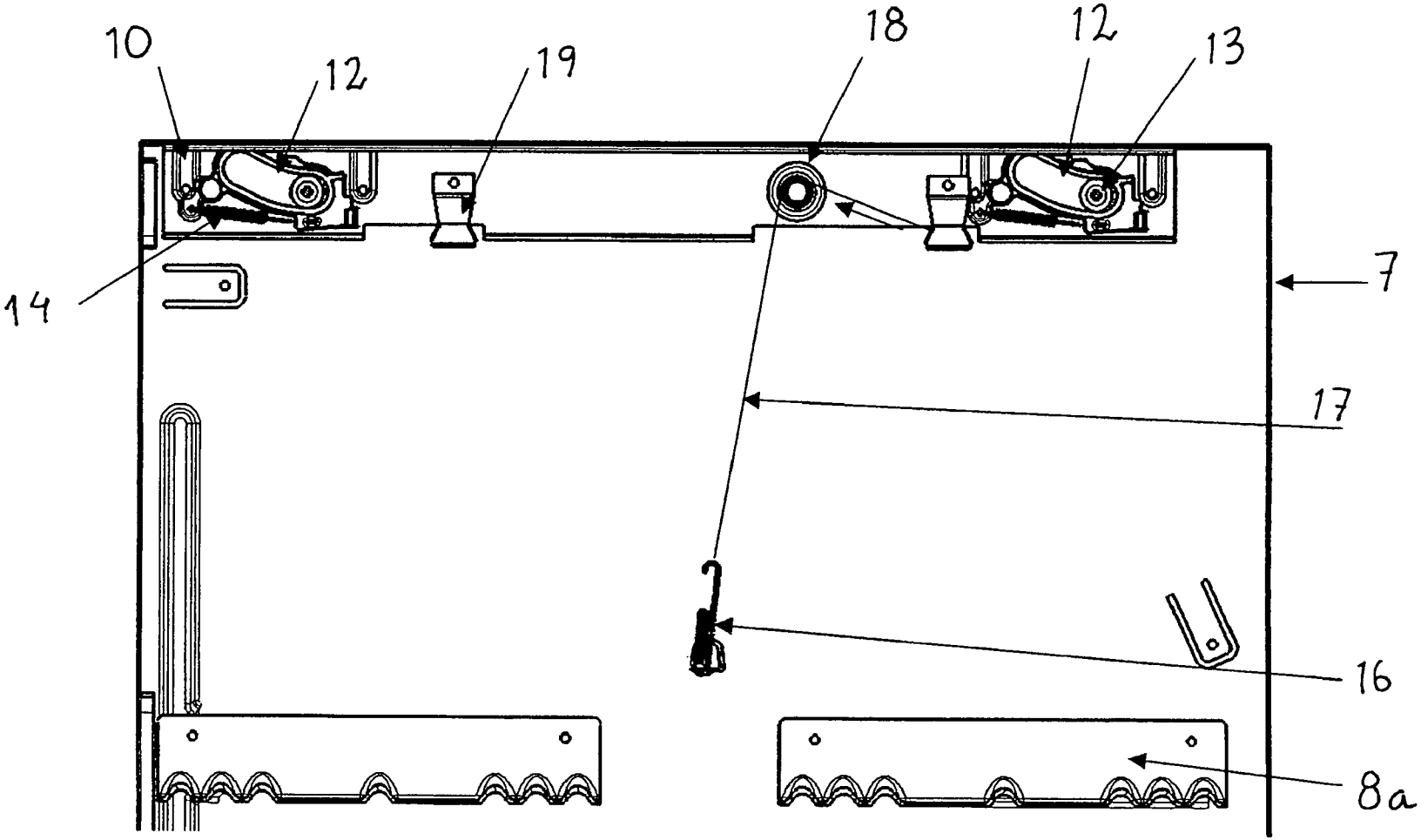
FIG. 4 schematically illustrates a cross section of a guide rail comprising a sealing device arranged in the upper part of a frame of the dishwasher drawer and wherein the drawer is loaded with plates.

The washing tub 2 is extractable relative to a frame 7 of the drawer dishwasher (see FIG. 4). The washing tub 2 can be arranged in a drawer, but in the following description the washing tub 2 is designed as a drawer so that the washing tub 2 and the drawer are the same unit.

In FIG. 2 och 3 the washing tub is arranged in the frame 7, and provided with a front panel 3. The frame 7 refer to the outer part, the cabinet, of the drawer dishwasher, and is designed to fit under a kitchen counter. The frame 7 surrounds the washing tub 2 and is preferably made of steel, or that like, but can also be made of other, for the purpose, suitable materials.

A glide strip 8*a* is stationary arranged on the inside of the frame 7. The washing tub 2, which is provided with corresponding strips 8*b*, is movable in the glide strip 8*a* arranged in the frame 7, between a closed position and a opened position relative to the frame 7.

The drawer dishwasher 1 further comprises a lid 9, for sealing engagement with the upper edge 6 of the washing tub 2. The lid 9 is movable between an engagement position A (see FIG. 2), wherein it is in sealing engagement with the upper edge 6 of the washing tub 2, and an opening position B (see FIG. 3), wherein it is spaced from the upper edge 6 of the washing tub 2.

The frame 7 encloses the washing tub 2 and the lid 9.

Figure 9:
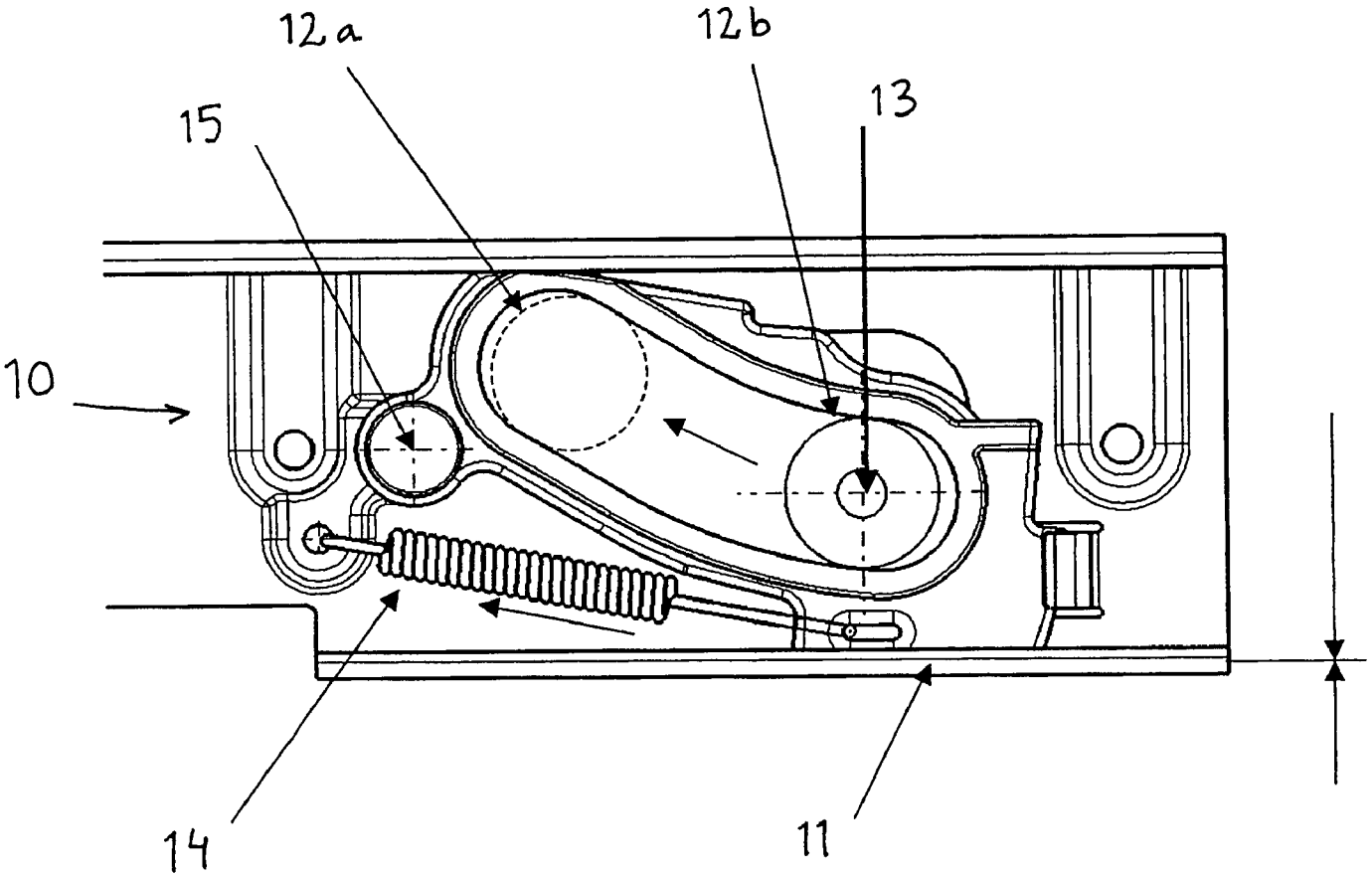
FIG. 9 schematically illustrates a detail of the sealing device comprising a guide and a biasing device when the lid is in a lower position.
Figure 10:
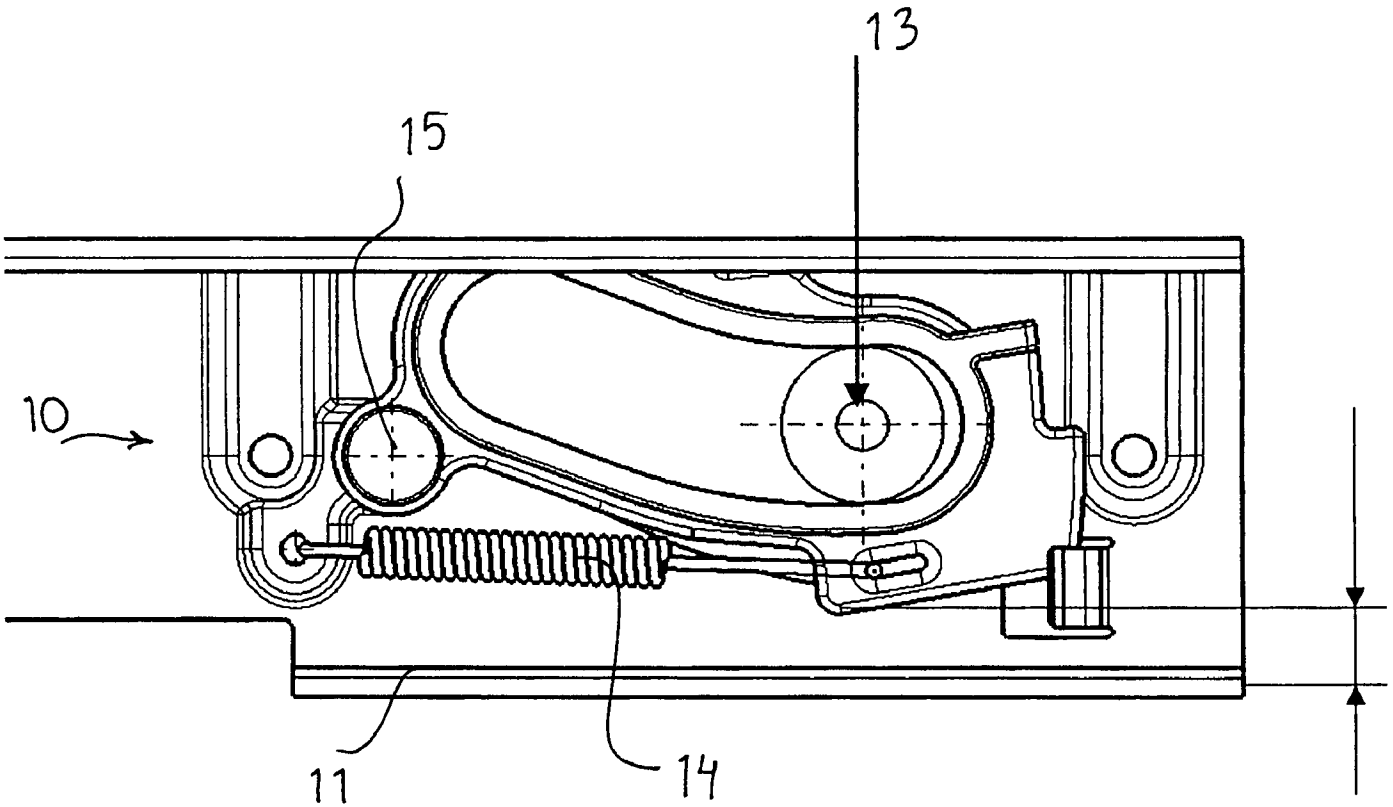
FIG. 10 schematically illustrates a detail of the sealing device comprising a guide and a biasing device when the lid is in an upper position.
Figure 11:
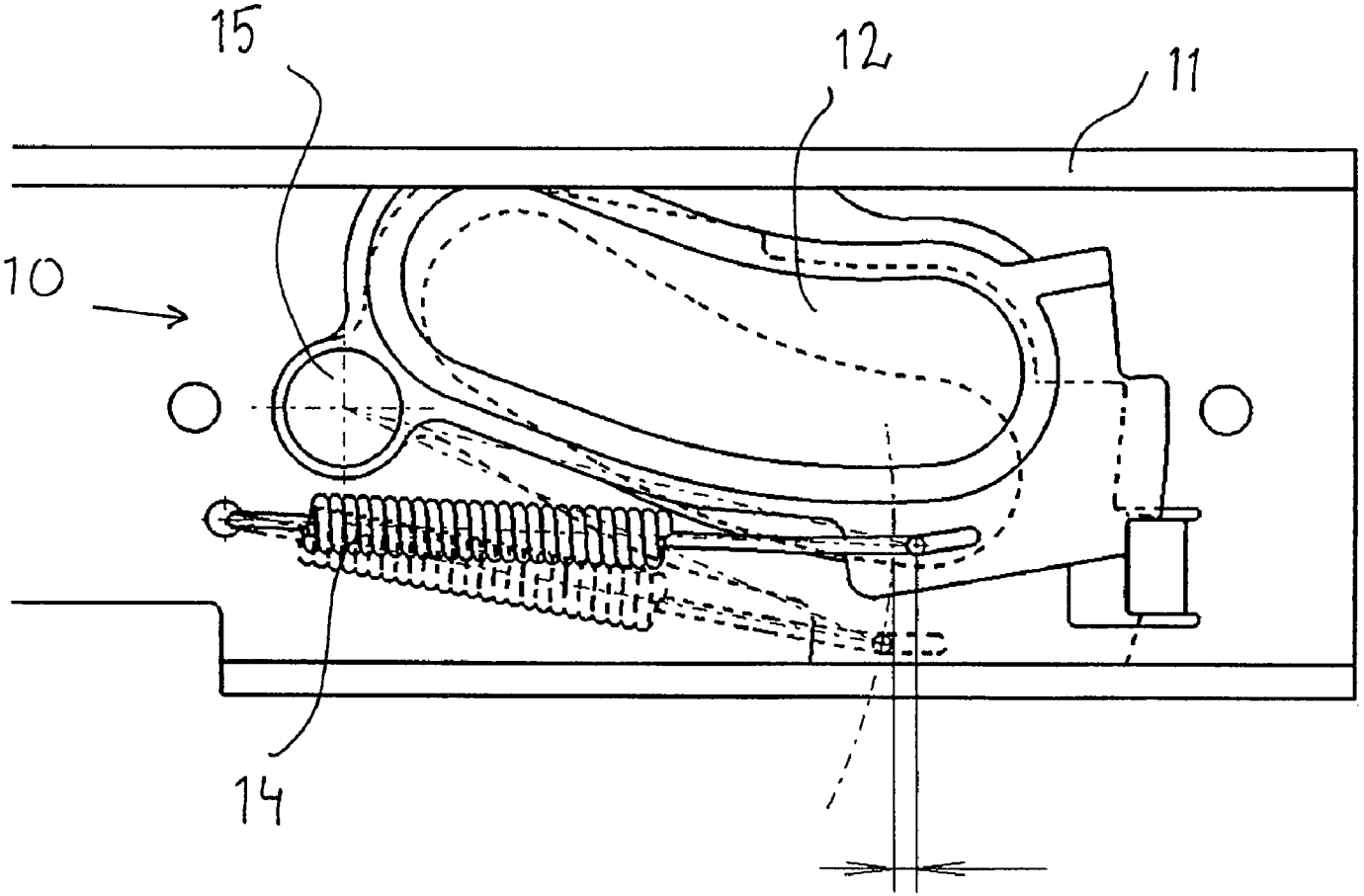
FIG. 11 schematically illustrates a detail of the sealing device comprising a guide and a biasing device when the lid moves between an upper position and a lower position.

The drawer dishwasher 1 further comprises a sealing device 10. The sealing device 10 is shown in FIG. 4. Details regarding the sealing device is shown in FIGS. 9-11. The sealing device is arranged to press the lid, when it is in the engagement position A, towards the upper edge 6 of the washing tub 2. By the term "press" is meant "to exert a force on the lid, the force being directed substantially vertically from the lid, towards the upper edge of the washing tub".

The sealing device 10 comprises a guide 12 and a biasing device 14. The sealing device 10 has a stamped portion, preferably made of steel or rigid plastic, to which the guide 12 and the biasing device 14 are attached.

The sealing device 10 is arranged on a guide rail 11. Two guide rails 11 are stationary arranged, in the upper part, on opposite sides of the inside of the frame 7.

The guide 12 has a curved form and extends from a front end 12*a* towards a rear end 12*b*. The front end 12*a* is in a laterally higher position, closer to the lid 9, than the rear end 12*b*. The guide 12 is preferably made of rigid plastic or that like.

The lid 9 is provided with a protruding projection 13. The projection 13 is protruding from an edge of the lid 9. The protruding projection 13 is movable in the guide 12. The protruding projection 13 can by way of example be a wheel. By this arrangement the lid 9 is movable in the guide 12 between said engagement position A and said opening position B.

The biasing device 14 of the sealing device 10 is arranged for pressing the lid towards the upper edge 6 of the washing tub 2 in the engagement position A. In one embodiment of the invention the biasing device 14 is a spring. The spring is arranged under the guide 12, with one end in connection to the front end 12*a* of the guide 12 and one end in connection to the rear end 12*b* of the guide 12. The biasing device 14 is movable relative to the guide 12.

The sealing device 10 is rotatable about an axle 15. The sealing device 10 is further attached to the guide rail 11 by the axle 15. The axle 15 can for example be a rivet or that like.

The distance D between the glide strip 8*a* and the guide rail 11 is about 230-245 mm. By arranging a sealing device 10 according to the present invention it is possible to adjust the sealing between the lid and the washing tub as regards manufacturing tolerances, the washing tub is made of plastic material, and the size of different washing tubes can differ some mm. The washing tub can also be affected by the generation of heat in the dishwasher. With an arrangement according to the invention it is possible to adjust the sealing between the washing tub and the lid and thereby achieve a secure sealing even though for example the size of the washing tubes differ some mm due to manufacturing tolerances.

Figure 5:
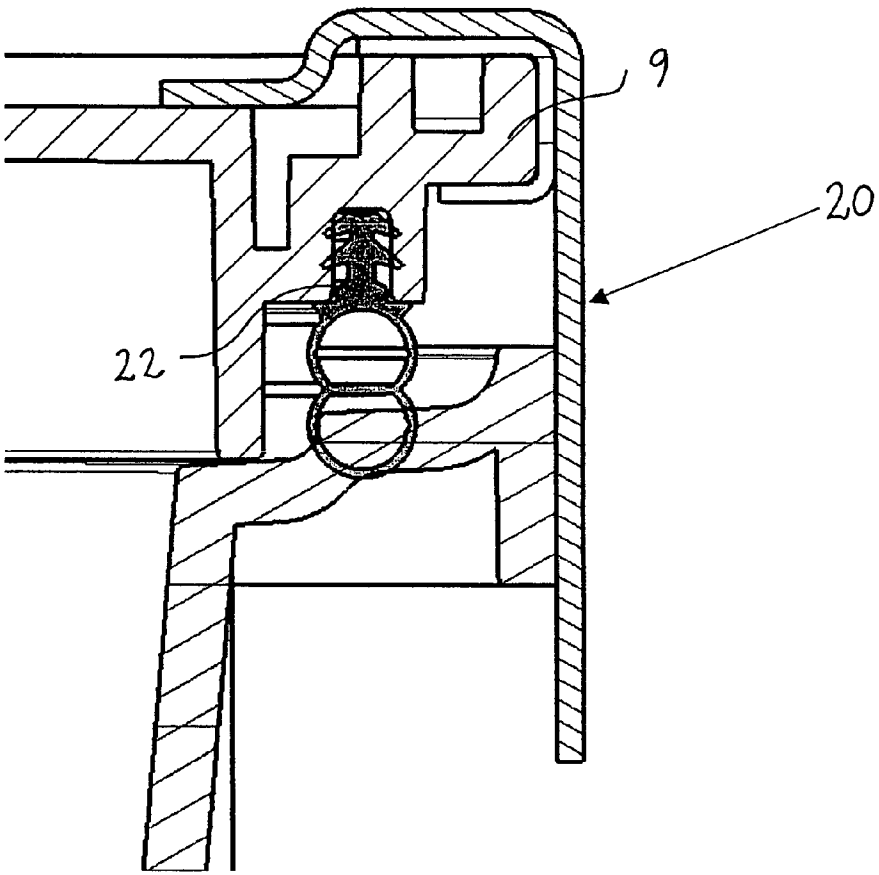
FIG. 5 schematically illustrates a detail of the sealing device, when the drawer is in the engagement position (closed position).
Figure 6:
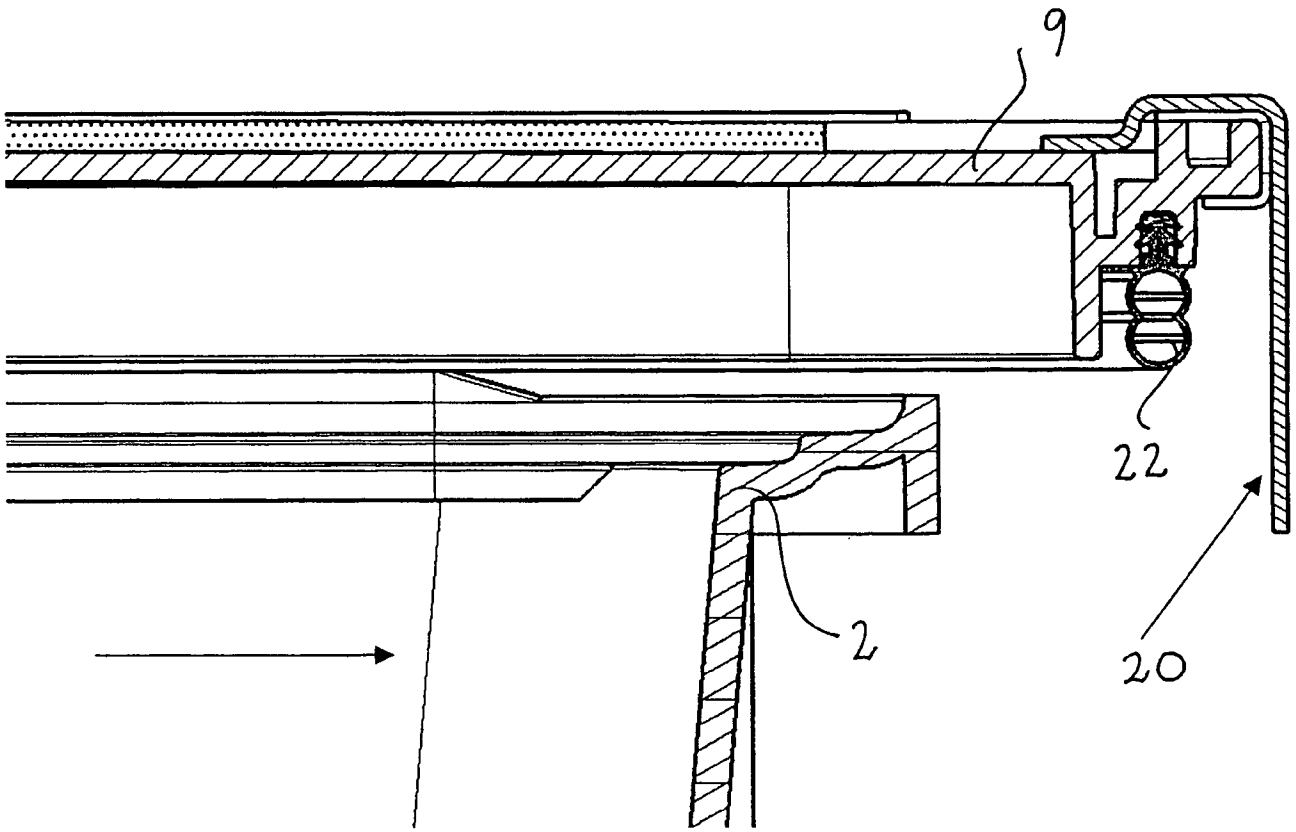
FIG. 6 schematically illustrates a detail of the sealing device, when the drawer is in the opening position.

The washing tub 2 is movable between a closed position (see FIGS. 2 and 5) and a opening position (see FIGS. 3 and 6). When the washing tub 2 is moved from the opening position towards the closed position, a roof (lid) pusher 20 (see FIG. 5), arranged in the rear part of the lid, begins to push the lid 9 from the opening position B towards the engagement position A.

When the lid 9 moves by means of the projection (wheel) 13, from the front end 12*a* of the guide 12 towards the rear end 12*b* of the guide a spring motion accure owing to the biasing device (spring) 14, the curved form of guide 12 and the axle 15.

When the washing tub 2 is moved from the closed position towards the opening position, the tension of the sealing device 10 helps the lid 9 from the engagement position A towards the opening position B.

When the lid is in the engagement position A, the projection 13 is in the rear end position 12*b* of the guide 12 and when the lid 9 is in the opening position B, the projection is in the front end 12*a* position of the guide 12. When the lid 9 is in the opening position B, about 20-40 mm of the front part of the lid is viewed outside the frame 7 of the dishwasher 1, preferably about 32 mm. Hence, the lid can serve to protect the counter and/or the wooden doors of the kitchen against stream from the dishwasher, when the dishwasher is in position under a kitchen counter (not shown).

FIG. 9 illustrates the sealing device 10 when the lid is in the engagement position A. The force on each projection/wheel 13 is about 15N when the lid 9 is in the engagement position A. This results in a total force, that presses the lid 9 towards the upper edge 6 of the washing tub 2 when in the engagement position A, of about 15N×4 wheels=60N.

FIG. 10 illustrates the sealing device 10 when it has adjusted for the tolerances it can adjust for at most. Due to the placement of the spring 14 the added force that is needed to seal the lid 9 towards the upper edge 6 of the washing tub 2 is only 27% (about 75N). Due to the arrangement a deviation of about 8 mm between the lid 9 and the washing tub 2 can be adjusted for and a secure sealing can still be achieved.

FIG. 11 illustrates the different between the position of the guide 12 and the spring 14 in FIG. 9 and FIG. 10.

Due to the curved form of the guide 12 the lid 9 moves up from the edge 6 of the washing tub 2 and out in the direction from the rear wall 5 of the washing tub 2 towards the front wall 4 of the washing tub 2.

Figure 7:
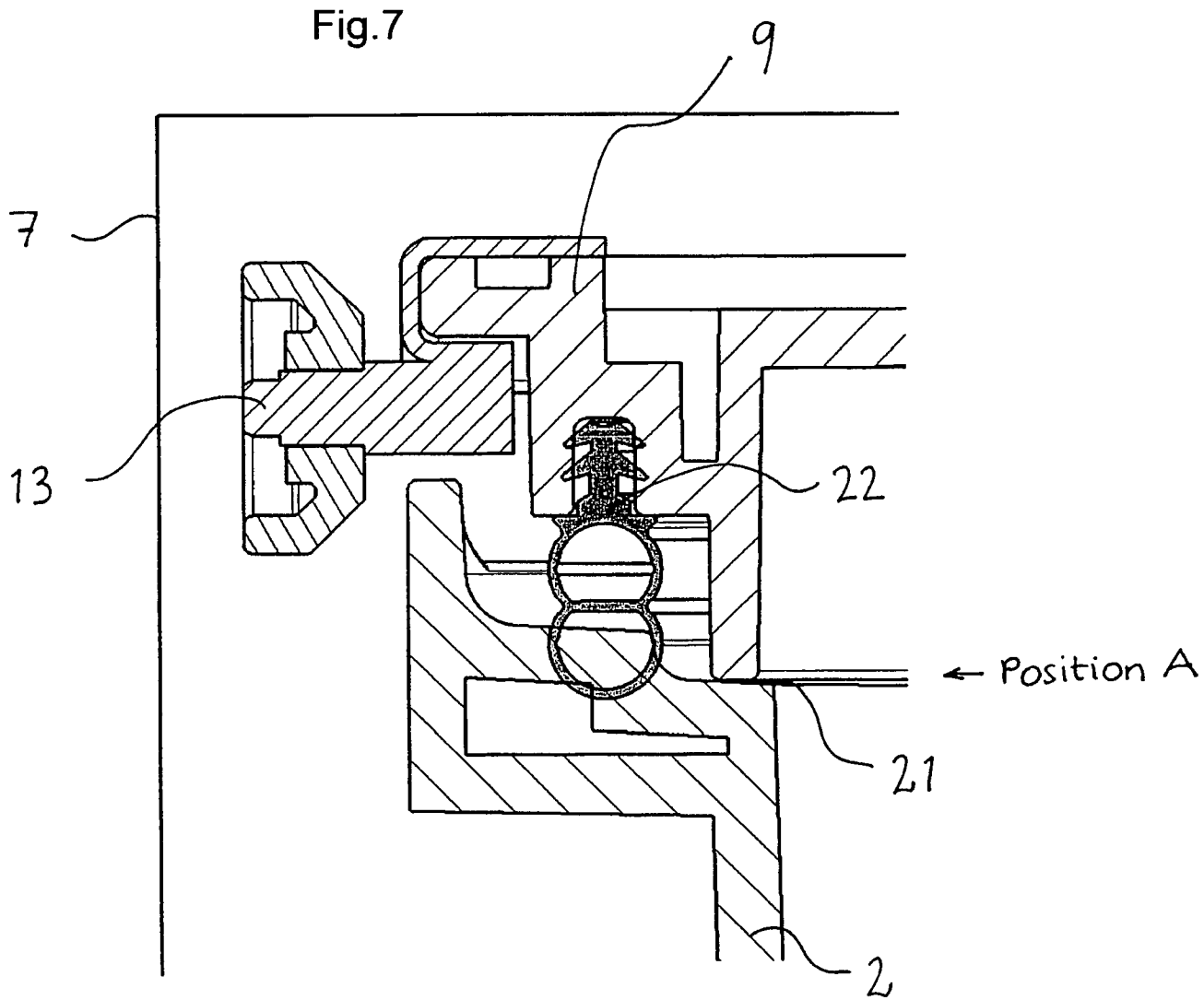
FIG. 7 schematically illustrates a detail of the sealing device, when the lid is in the engagement position (closed position).
Figure 8:
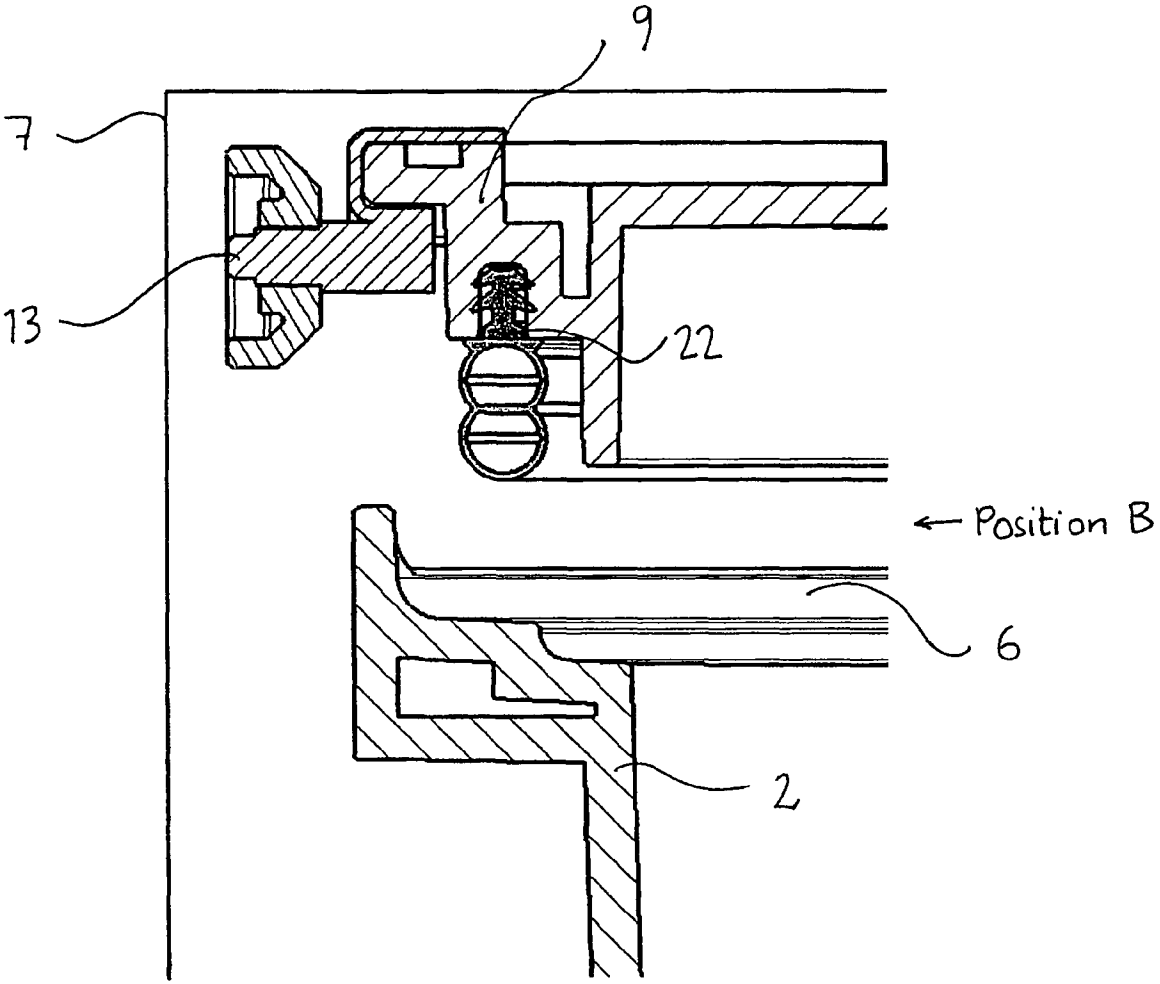
FIG. 8 schematically illustrates a detail of the sealing device, when the lid is in the opening position.

In FIG. 7 the lid 9 is in the engagement position A and a contact surface 21 between the lid 9 and the upper edge 6 of the washing tub 2 is achieved. The material of which the lid and the washing tub are made of, for example some kind of hard, plastic material gets in direct contact with each other. It is possible to provide a secure sealing according to the description above because of the design of the sealing device 10.

A sealing gasket 22 is arranged underneath the lid as a precaution to avoid the risk of leakage. The sealing gasket 22 has low force of compression and is preferably made of extruded, thin-walled silicone rubber, but can also be made of other, for the purpose, suitable materials. By achieving the platic-to-plastic contact it is guaranteed that the sealing gasket 22 is compressed just as much each time the lid 9 is moved to the engagement position A, and by this is a secure sealing between the lid and the upper edge of the washing tub guaranteed. The gasket 22 is arranged on the outside of the contact surface 21.

An arrangement for pulling out the lid 9 in the opening position is provided in the dishwasher 1, se FIG. 4. The arrangement comprises a spring 16, which is vertically arranged in the lower part of the frame 7. The spring 16 is attached to a wire 17, which extends vertically from the spring 16 towards the guide rail 11. A "breaking wheel" 18 is arranged on the guide rail 11. The wire 17 turns around the wheel 18 and continues in a horizontal direction towards the rear part of the guide rail 11. The wire is attached to a control element 19.

Two control elements 19 are attached to the lid, see FIG. 4. They are arranged to regulate the movement of the lid 9 laterally.

In one embodiment of the invention the control elements 19 consists of pieces of metal. Four elements 19 are arranged on opposite sides, two on each side, of the lid 9, see FIG. 4.

In the drawings and specification, there have been disclosed preferred embodiments and examples of the invention and, although specific terms are employed, they are used in a generic and descriptive sense only and not for the purpose of limitation, the scope of the invention being set forth in the following claims.

The invention claimed is:

1. A drawer dishwasher, comprising: an extractable washing tub (2) for receiving objects that are to be washed, and a lid (9), for sealing engagement with the washing tub (2), the lid (9) is movable between an engagement position (A), wherein it is in sealing engagement (10) with an upper edge (6) of the washing tub (2), and an opening position (B), wherein it is spaced from the upper edge (6) of the washing tub (2), the dishwasher has a sealing device (10) arranged to press the lid (9), when it is in the engagement position (A), towards the upper edge (6) of the washing tub (2), wherein the sealing device (10) is arranged on a guide rail (11), said guide rail (11) being stationary arranged relative to a frame (7), which encloses the washing tub (2) and the lid (9) wherein the lid (9), in the opening position (B), is extracted from the frame as relative to the engagement position (A).

2. The drawer dishwasher as claimed in claim 1, wherein the guide rail (11) is arranged in the upper part of the frame (7).

3. The drawer dishwasher as claimed in claim 1, wherein the sealing device (10) comprises a guide (12), in which a projection (13) protruding from an edge of the lid (9) is movable between said engagement position (A) and said opening position (B).

4. The drawer dishwasher as claimed in claim 1, wherein the sealing device (10), further comprises a biasing device (14) for pressing the lid (9) towards the upper edge (6) of the washing tub (2) in the engagement position (A).

5. The drawer dishwasher as claimed in claim 4, wherein the biasing device (14) is movable relative to the guide (12).

6. The drawer dishwasher as claimed in claim 4, wherein the biasing device (14) is a spring.

7. The drawer dishwasher as claimed in claim 1, wherein at least two sealing devices (10) are arranged on opposite sides, in the upper part of the frame (7) of the dishwasher (1).

8. The drawer dishwasher as claimed in claim 7, wherein at least two guide rails (11) are arranged on opposite sides of the frame (7), and wherein each of the two guide rails (11) comprises at least one sealing device (10) comprising a guide (12) and a biasing device (14).

9. The drawer dishwasher as claimed in claim 7, wherein each of the two guide rails (11) comprises at least two sealing devices (10) comprising two guides (12) and two biasing devices (14).

10. The drawer dishwasher as claimed in claim 1, wherein the lid (9), in the opening position (B) is only partially extracted relative to the engagement position (A).

* * * * *